US008925678B2

(12) United States Patent
Tizzoni

(10) Patent No.: US 8,925,678 B2
(45) Date of Patent: Jan. 6, 2015

(54) NOISE BARRIER STRUCTURE WITH SOUND-ABSORBING AND SOUND-REDIRECTING PROPERTIES, AND HIGH PERFORMANCE SOUND ABSORBER FOR USE IN SUCH STRUCTURE

(75) Inventor: Giampaolo Tizzoni, Pontedera (IT)

(73) Assignee: Urbantech S.p.A., Pontedera (Pisa) (IT)

( * ) Notice: Subject to any disclaimer, the term of this patent is extended or adjusted under 35 U.S.C. 154(b) by 0 days.

(21) Appl. No.: 13/982,621

(22) PCT Filed: Feb. 6, 2012

(86) PCT No.: PCT/IB2012/505533

§ 371 (c)(1),
(2), (4) Date: Sep. 10, 2013

(87) PCT Pub. No.: WO2012/107871

PCT Pub. Date: Aug. 16, 2012

(65) Prior Publication Data

US 2014/0291069 A1 Oct. 2, 2014

(30) Foreign Application Priority Data

Feb. 7, 2011 (IT) ..... PI2011A0011

(51) Int. Cl.

| | |
|---|---|
| ***B64F 1/26*** | (2006.01) |
| ***E04B 1/82*** | (2006.01) |
| ***E01F 8/00*** | (2006.01) |

(52) U.S. Cl.

CPC ..... *E04B 1/8209* (2013.01); *E01F 8/0035* (2013.01); *E01F 8/077* (2013.01)

USPC ..... 181/293; 181/210; 181/284

(58) Field of Classification Search

CPC ..... B64F 1/26

USPC ..... 181/210, 293, 284

See application file for complete search history.

(56) References Cited

U.S. PATENT DOCUMENTS

| | | | | |
|---|---|---|---|---|
| 3,307,809 | A * | 3/1967 | Lynn | 244/114 R |
| 4,274,506 | A * | 6/1981 | Blomgren et al. | 181/210 |
| 4,402,384 | A * | 9/1983 | Smith et al. | 181/210 |
| 4,650,032 | A * | 3/1987 | Boehlau et al. | 181/210 |
| 5,709,053 | A * | 1/1998 | Kuroda | 52/145 |
| 2003/0006090 | A1 | 1/2003 | Reed | |

(Continued)

FOREIGN PATENT DOCUMENTS

| | | | |
|---|---|---|---|
| DE | 26 19 894 | A1 | 11/1977 |
| WO | WO 2007/132964 | A1 | 11/2007 |
| WO | WO 2010/092606 | | 8/2010 |

OTHER PUBLICATIONS

International Search Report and Written Opinion of PCT/IB2012/050533 dated Jun. 20, 2012.

*Primary Examiner* — Forrest M Phillips

(74) *Attorney, Agent, or Firm* — Lucas & Mercanti, LLP

(57) ABSTRACT

A noise structure having a barrier made of a generally sound redirecting material defining a surface of the barrier, and a plurality of sound absorbing boxes connected to this surface, each box comprising a rear wall and an extensively perforated front wall, the walls defining a longitudinal channel at least partially occupied by a filling made of a sound absorbing material, in which the rear wall is a substantially flat plane wall assembled parallel to and spaced apart from the surface of the barrier and is in its turn extensively perforated.

25 Claims, 5 Drawing Sheets

(56) References Cited

U.S. PATENT DOCUMENTS

2005/0263343 A1* 12/2005 Yano et al. ..... 181/210
2006/0219475 A1* 10/2006 Olsen et al. ..... 181/214
2010/0243369 A1* 9/2010 Fusiek et al. ..... 181/210

* cited by examiner

NOISE BARRIER STRUCTURE WITH SOUND-ABSORBING AND SOUND-REDIRECTING PROPERTIES, AND HIGH PERFORMANCE SOUND ABSORBER FOR USE IN SUCH STRUCTURE

CROSS-REFERENCE TO RELATED APPLICATIONS

This application is a 371 of PCT/IB2012/05053, filed Feb. 6, 2012, which claims the benefit of Italian Patent Application No. PI2011 A00011, filed Feb. 7, 2011, the contents of each of which are incorporated herein by reference.

FIELD OF THE INVENTION

The present invention concerns the technical field of noise barriers.

In particular, this invention relates to a noise structure provided with a special sound absorbing element, or sound absorbing acoustic absorber, which can be applied to selected points of a generally sound redirecting noise barrier.

BACKGROUND OF THE INVENTION

Depending on the materials they are made of, noise barriers can have very different sound absorbing or sound redirecting characteristics. By way of example, noise barriers made of autoclaved aerated concrete (better known with the "porenbeton" trade name), although presenting many technical advantages, generally have quite poor sound absorbing performances. In fact, it is known that such barriers, when not processed with special treatments, fall within the A1 classification (the lowest one according to UNI EN 1793-1 Regulation) while, depending on the practical applications, it should be necessary to cover all acoustic classifications until the highest one, e.g. A4.

Such a problem is of course present not only with barriers made of porenbeton, but also with those made of different materials such as, for example, normal concrete.

For this purpose, the present applicant has filed, on Feb. 13, 2009, an Italian patent application (No. PI2009A000013) disclosing a plurality of sound absorbing acoustic boxes which can be applied to a sound redirecting barrier in such a way to locally increase its sound absorption characteristics, to optimize the absorption of sound by the barrier according to the needs and find the best balance between the intrinsic sound redirecting properties of the barrier and the sound absorption.

According to the above patent application, the boxes have a parallelepiped shape and are filled with a proper sound absorbing material. The front side of the boxes is then perforated so that the sound captured by the boxes enters the boxes themselves to be then absorbed by the sound absorbing filling material.

However, such acoustic boxes are not particularly efficient insomuch as a large number of them needs to be applied to increase the sound absorption properties of the barrier until reaching A4 level, with a consequent increase in costs and difficulties in the production, assembly and maintenance.

SUMMARY OF THE INVENTION

Reconsidering the above problem, the applicant has now reached a particularly and surprisingly effective solution which, by combining in an unprecedented way a plurality of devices relating both to the structure of the boxes and to their assembly on the barrier, obtains a noise barrier mainly made of sound redirecting material (such as, for example, porenbeton or concrete) which also has high-performance sound absorption characteristics even with a relatively small number of boxes (as to the percentage of the occupied sound redirecting surface), which can be adjusted case by case on the basis of the specific needs of each segment of the barrier.

At the same time, and as a consequence thereof, the present invention attains the object of reducing the production, assembly and maintenance costs of the noise structure, also thanks to a particularly simple and practical system for mounting the boxes.

The main characteristics of a noise structure and of a sound absorbing box reaching the above described and other additional objects are set out, respectively, in the annexed claims 1 and 17.

According to a first aspect of the invention, the noise structure comprises a plurality of sound absorbing boxes connected to the surface of a noise barrier, said boxes having perforated front walls and a filling made of a sound absorbing material in such a way that a rear flat wall of each box, in its turn extensively perforated, is parallel to and spaced apart from the mentioned surface. Preferably, the distance between the rear wall of the box and the surface of the barrier is comprised between 2 cm and 9 cm, even more preferably between 3 cm and 4 cm. Thanks to this solution, a strong additional acoustic absorption can be obtained, due both to porosity (the porosity of the filling material) and cavity resonance (as better explained hereafter), caused by the very chamber resulting between the box and the surface of the barrier.

Advantageously, between two boxes placed and spaced apart one under the other, an Helmholtz resonator effect is also obtained because of the chambers behind the rear walls and the gap between the two boxes, the latter representing the neck of the resonator. This effect in its turn maximizes the effectiveness of the structure.

In a further advantageous solution, if the boxes are placed in rows, one row above the other, the boxes of a row being staggered with respect to the boxes of an adjacent row, a space is created between two boxes placed in a side-by-side relationship in the same row which, together with the gap formed with a staggered box of an adjacent row, creates a second Helmholtz resonator effect in a direction parallel to the surface of the barrier, the neck of such a second resonator corresponding to the mentioned space between the two boxes placed in a side-by-side relationship.

The perforated front wall of the box can be prismatic, semi-cylindrical or in any case concave with axis parallel to the longitudinal axis of the box itself. In case of a semi-cylindrical wall, the radius of curvature is preferably comprised between 10 cm and 13 cm, even more preferably of approximately 11.5 cm. Such a wall has a particularly effective acoustic absorption result due to reflection and porosity, which can be enhanced also by the side walls, perforated in their turn and transversally closing the longitudinal inner channel formed by the box.

Again, another important and advantageous contribution to the overall sound absorbing effectiveness of the barrier can be given by an embodiment in which the filling of the box made of sound absorbing material comprises a base layer placed parallel and adjacent to the rear plane wall and a plurality of front layers superimposed one upon the other on respective planes orthogonal to the rear wall and parallel to the longitudinal axis of the box, the front layers having a rear end close to the base layer and a front end spaced apart from the front side, the front ends being mutually staggered between two or more adjacent layers so as to determine a stepped front of the filling.

If the material has a fibrous structure with unidirectional arrangement of the fibers, for at least some of the mentioned front layers the direction of the fibers can advantageously be set so as to be orthogonal with respect to the rear wall. Preferably, the filling material (for example polyester felt, mineral wool, glass wool) can have—as far as at least some of the front layers are concerned—fibers exposed irregularly on the front ends. Such an internal configuration creates a further effect of acoustic absorption in addition to the normal absorption due to porosity of the filling material and to the traditional cavity resonance inside the box; in fact, the stepped hollow space resulting between the front wall and the front ends of the layers can be compared to a Schroeder diffuser, the effectiveness of which is increased by the fibers exposed on at least some of the layers.

The combination of the above mentioned sound absorbing effects results in a really unprecedented effectiveness in the field of noise systems for road use, due to the synergic combination of eight effects of acoustic absorption which obviously well surpass the two or three typical effects of traditional systems.

As to the fixing of the boxes to the barrier, this can be advantageously carried out by way of a quick connection system which provides for one of more stud(s) projecting from the rear wall of the box, provided at the free end with an enlarged head which engages by sliding in a linear track integral with the surface of the barrier. In an alternative solution, the connection can be obtained through connecting wings which integrally elongate from the front wall beyond the rear wall of the box.

BRIEF DESCRIPTION OF THE DRAWINGS

Further characteristics and advantages of the present invention will be apparent from the following description of embodiments thereof, given as non-limiting examples with reference to the attached drawings, wherein.

DESCRIPTION OF PREFERRED EMBODIMENTS

Figure 1:
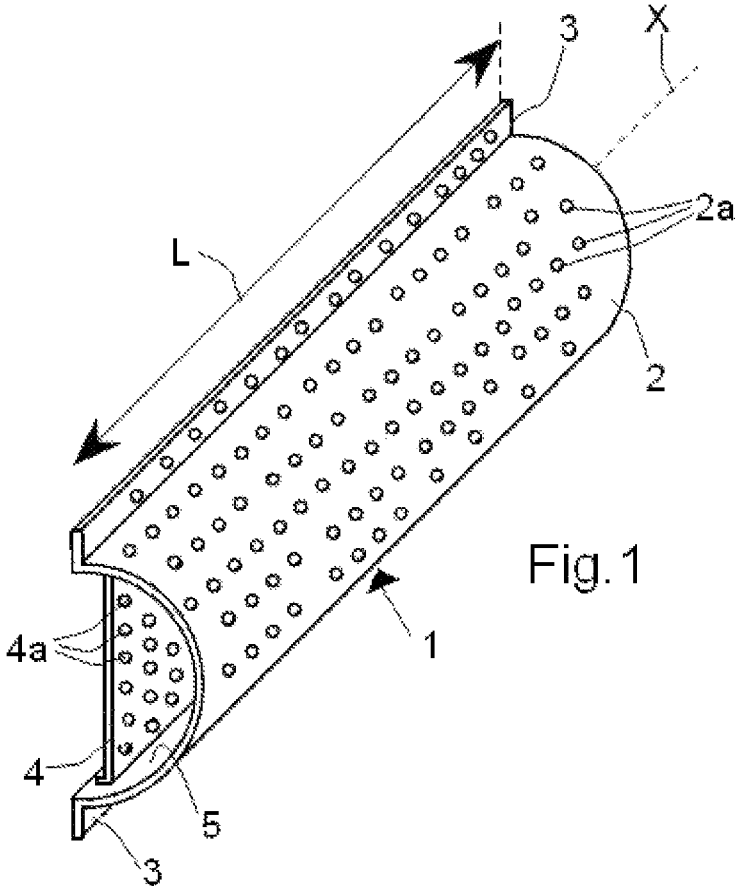
FIGS. 1 and 2 show, in the first case more schematically, in the second case in detail, and still in an axonometric view, an example of sound absorbing box according to the present invention.

With reference to said figures, an acoustic box according to the present invention provides for a box-shaped body 1 having a pre-determined length L according to a longitudinal axis X which can vary according to the needs. A length L of approximately 2 m should preferably be chosen although different lengths can clearly be selected. Always as shown in FIG. 1, the body 1 presents a front wall 2 having a concave shape, with the axis of concavity coinciding with or being parallel to the axis X. The front wall by way of example can have a semi-circular cross section with a predetermined radius R. For example, it has been verified that a radius comprised between 10 cm and 13 cm, preferably of approximately 11.5 cm, offers a particular maximization of the performances, as better explained afterwards.

In a first embodiment (FIGS. from 1 to 3), from the ends of the front wall 2 two attaching wings 3 branch off, which are then used for the connection to a surface of a barrier made of sound redirecting material constituting the main body of the noise structure. The front wall is extensively perforated with holes 2*a*.

Figure 3:
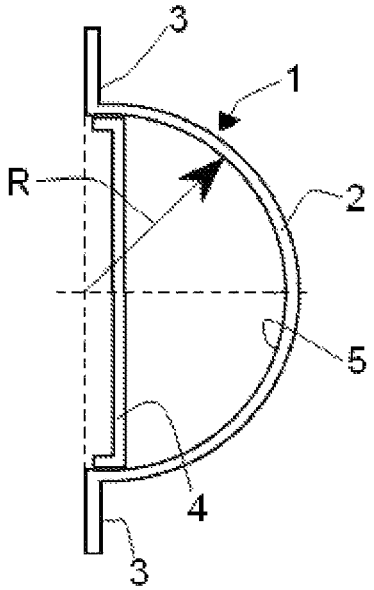
FIG. 3 is a side view of the box in FIGS. 1 and 2, deprived of the filling material and of a closing side wall.
Figure 2:
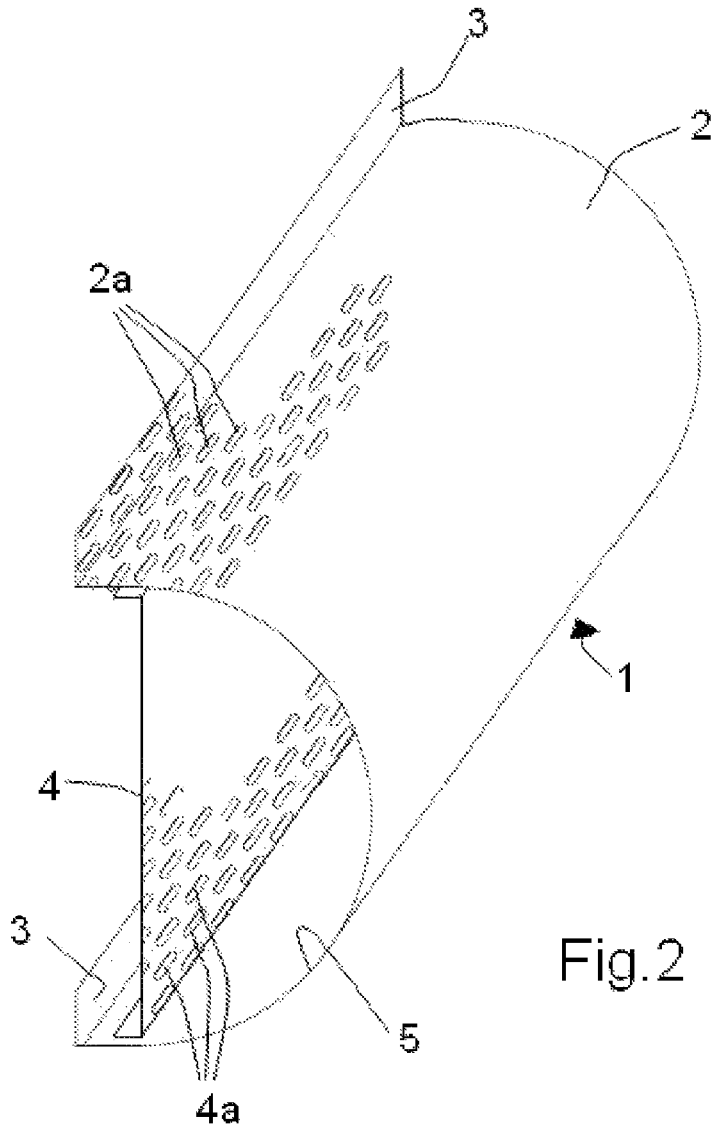

As clearly shown in FIG. 3, a flat rear wall 4 is placed parallel to the axis X so as to close the concavity of the front wall creating a longitudinal channel 5. The rear wall 4 is in its turn extensively perforated with holes 4*a*. The connection between the box and the sound redirecting barrier results, according to the present invention, in a spaced disposition of the rear wall with respect to the surface of the barrier, which can be obtained in this embodiment with the wings 3 which extend beyond the wall 4, suitably dimensioned or provided with additional spacers.

Figure 5:
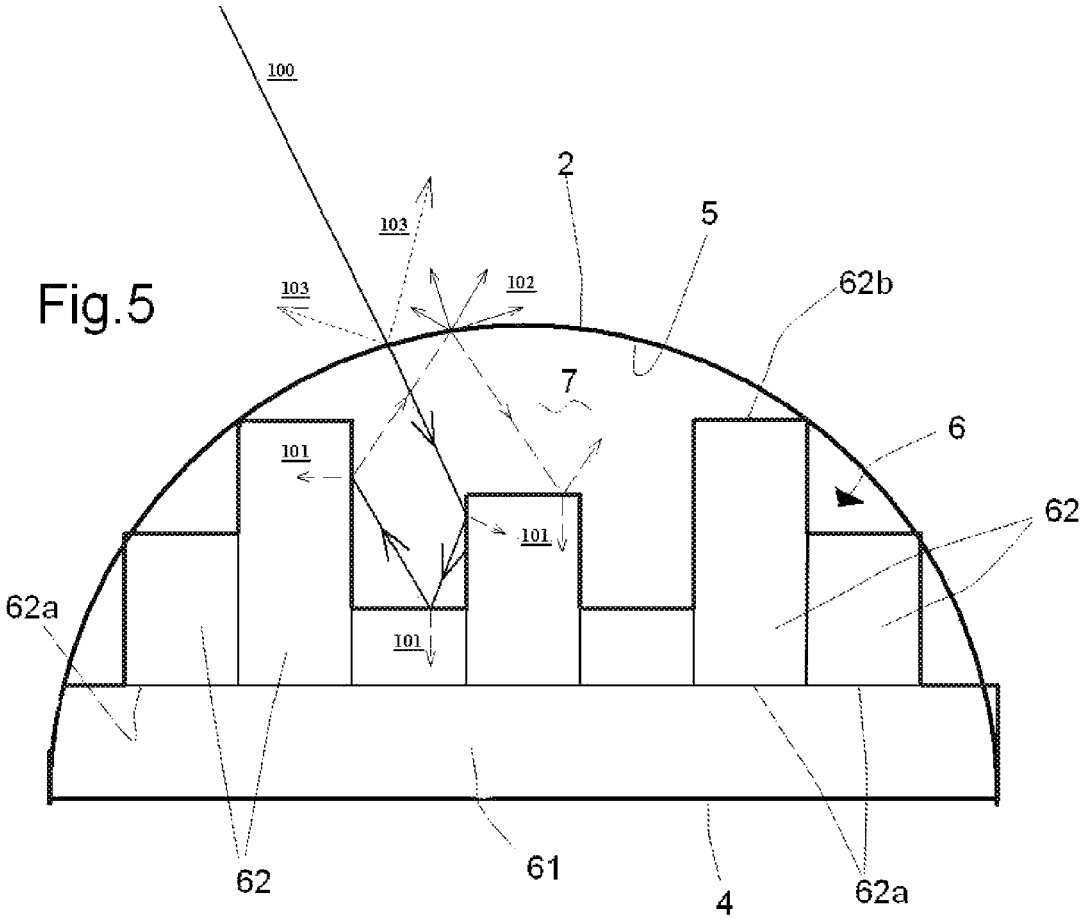
FIGS. 4 and 5 are again schematic side views of the box deprived of a closing side wall, with the sound absorbing filling material and showing, in FIG. 5, the relevant acoustic effect.
Figure 4:
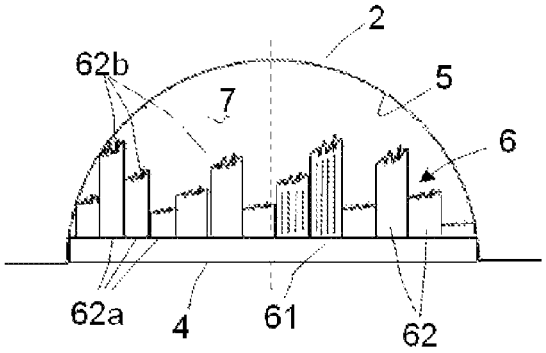

As shown in particular in FIGS. 4 and 5, a filling made of sound absorbing material 6, preferably a polyester felt or other typically sound absorbing materials such as mineral wool or glass wool, is inserted inside the channel.

Although not depicted in the figure, two closing side walls, in their turn perforated, are generally provided for and placed crosswise to close the channel 5 at the two longitudinal ends, so as to insulate the filling comprised inside the channel.

The incident sound enters the channel 5 through the holes 2*a* and 4*a* formed in the front wall 2 of the box, on the rear wall 4 and on the closing side walls.

As shown in particular in FIG. 4, the filling 6 occupies the internal channel 5 and preferably comprises a base layer 61 placed parallel and adjacent to the flat rear wall 4 and a plurality of front layers 62 superimposed one upon the other on respective planes orthogonal to the rear wall and parallel to the longitudinal axis X. The front layers 62 have a rear end 62*a* close to the base layer and a front end 62*b* spaced apart from the front wall 2. The front ends are mutually staggered between two or more adjacent layers so to determine a stepped front of the filling, which in its turn ends up in a stepped hollow space 7.

Such a particular configuration of the filling material can be obtained by simply cutting the single layers in pieces out of an endless polyester band (as in the figures) or by directly obtaining the desired stepped shape in a unitary block.

In such a way, a configuration is obtained that is analogous to a Schroeder diffuser, of unprecedented use with materials such as polyester in noise barriers, which is extremely advantageous because it allows to notably increase the sound absorption properties with respect to the state of the art. As shown in FIG. 5, the sound rays entering the channel 5 through the perforations 2*a* (only one incident sound ray 100 has been depicted for the sake of clarity in the figure) are subjected to multiple reflections inside the hollow space 7 thanks to the presence of the steps. FIG. 5 therefore shows—with the dotted line 101—the portion of sound absorbed by any single step 62 while only a part 102 can come out from the sound absorbing box.

However, as shown again in the same figure, the special curved (in particular, semi-cylindrical) shape of the sound absorbing box allows to considerably reduce the percentage of the output sound radiation. Thanks to the curvature, the outwards directed ray 102 is in fact broken down according to a spider-like diffraction instead of following a single way out. Therefore, each single point at a given front distance from the box will be reached by only a small portion of the incident sound radiation. In addition to this, again as shown in FIG. 5, the semi-circular shape is able to break down not only the small percentage of outwards directed sound radiation but also the radiation component, indicated at 103, which does not enter the perforations but is reflected by the front wall 2.

FIG. 4 then shows how, in order to further optimize the absorption, the filling material has a fibrous structure with unidirectional direction of the fibers, and in at least some of the front layers 62 the direction of the fibers is the one orthogonal to the rear wall 4, with the fibers that, in at least some of the front layers 62, are irregularly exposed on the front ends 62*b*. The exposition of the fibrous side, i.e. the side in which the fiber ends tend to protrude, on some of the layers, possibly alternated with crosswise dispositions of the fibers in the longest layers so as to expose the fibers on the side faces instead of on the ends, in fact allows for a better absorption of the incident sound radiation, if compared with an arrangement in which the fibers lie parallel to the outer surface.

Figure 6:
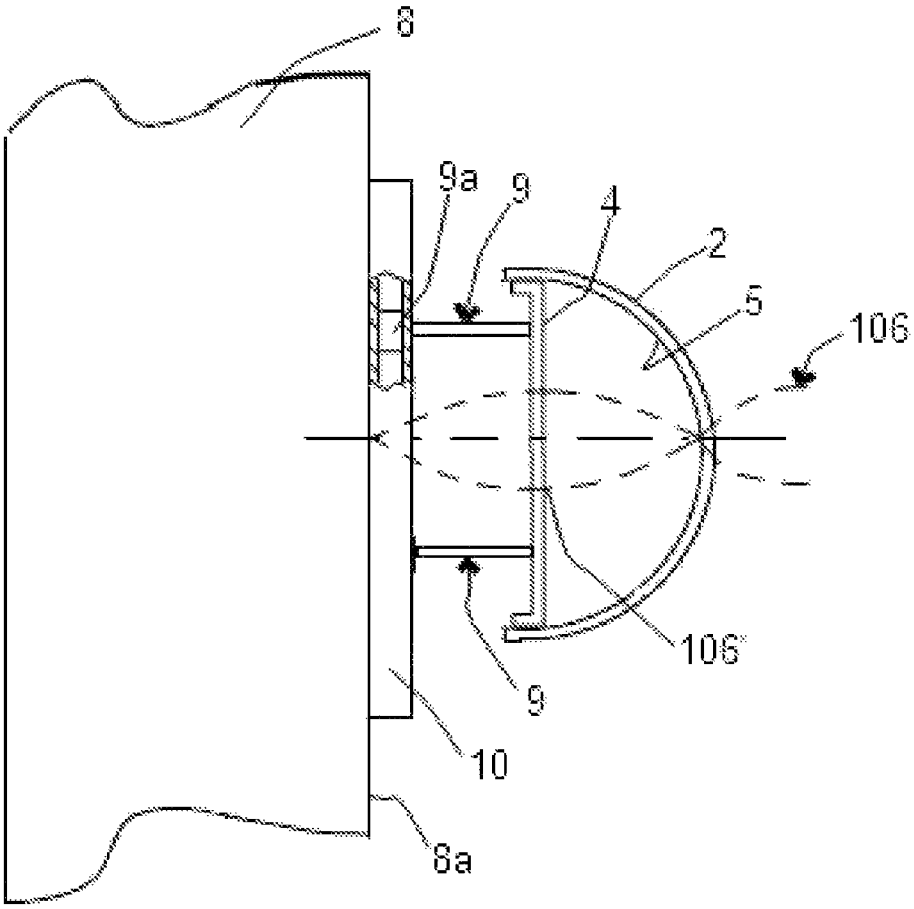
FIG. 6 is a schematic side view as in FIG. 3 of a second embodiment according to the present invention, coupled with the surface of the relevant sound insulating barrier.

In a second embodiment of the present invention, as schematically shown in FIG. 6, the fastening wings can be omitted and in this case the spaced-apart connection to surface 8*a* of a barrier 8 (made of a sound redirecting material such as porenbeton or normal concrete) is carried out through studs 9 which project orthogonally from the rear wall 4 and insert by sliding with enlarged heads 9*a* in tracks 10 (by way of example the so-called Halfen® profiles, which are U-shaped and have inwards folded rims) which are applied directly to barrier 8.

The sound absorbing box formed by the rear wall 4 and the concave front wall 2 can be made as one or in two separate pieces which are then joined together. It is apparent that any material can be used: aluminum, zinc-plated steel, recycled plastic and so on.

The distance between the rear wall 4 and the surface 8*a* of the barrier 8 can be preferably comprised between 2 cm and 9 cm. The technical result of this spacing, which can be obtained, as seen, also with the first embodiment, is to highly increase the sound absorption characteristics because the fraction of sound radiation which is not directly captured by the front wall 2 and is reflected/deviated by the barrier is captured by the rear wall 4 and by the filling 6. Said reflected radiation is represented and indicated at 106 in FIG. 6 and, as can be noted, the peak of the wave 106' results exactly where the sound absorbing material is placed, thus allowing the box to be particularly effective in the reduction of such a component. Within the above mentioned range, distances between 4 cm and 8 cm, but more specifically and effectively between 3 cm and 4 cm, are particularly indicated for high-frequency noise components (3150-8000 Hz).

Figure 7:
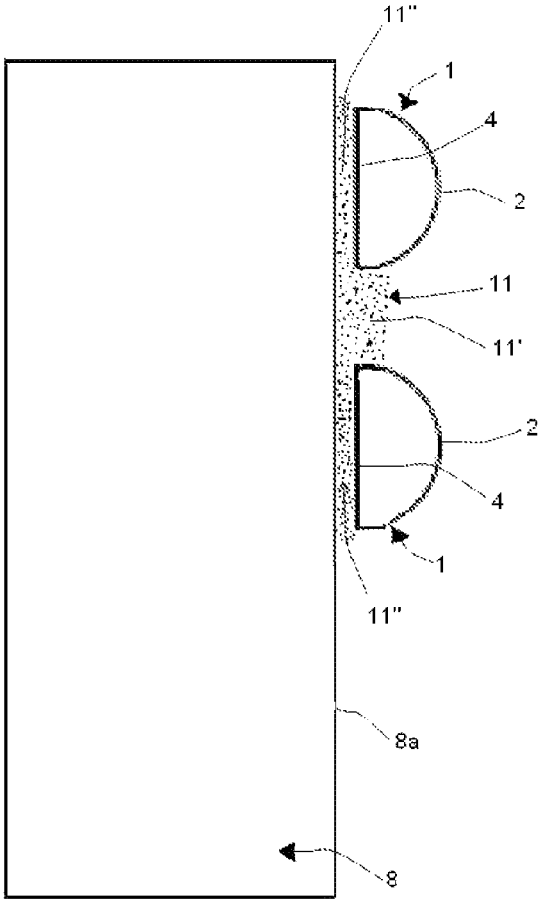
FIGS. 7 and 8 schematically show the effect obtained by applying the boxes superimposed one upon the other and/or arranged in a side-by-side relationship to form Helmholtz resonators.

Moreover, the spacing between the rear wall and the barrier, as shown in FIG. 7, causes an additional effect of sound absorption similar to that of a first Helmholtz resonator in a direction orthogonal to the surface 8*a* of the barrier 8. In fact, considering rows of boxes arranged in a side-by-side relationship along a common longitudinal axis, with the rows extending in a parallel and spaced-apart way so to form a gap 11' between a box in a row and a box in another row, a first region 11 (dotted area) will be obtained, comprising the mentioned gap 11' and the two chambers 11" defined between the surface 8*a* and the rear walls 4 of the boxes. This first region defines a first Helmholtz resonator, the neck of which corresponds to the gap 11' between two boxes of different rows. In such a way, the sound radiation entering the gap 11' between the rows, i.e. the mentioned neck, is further dampened with a notable maximization of the performances.

Figure 8:
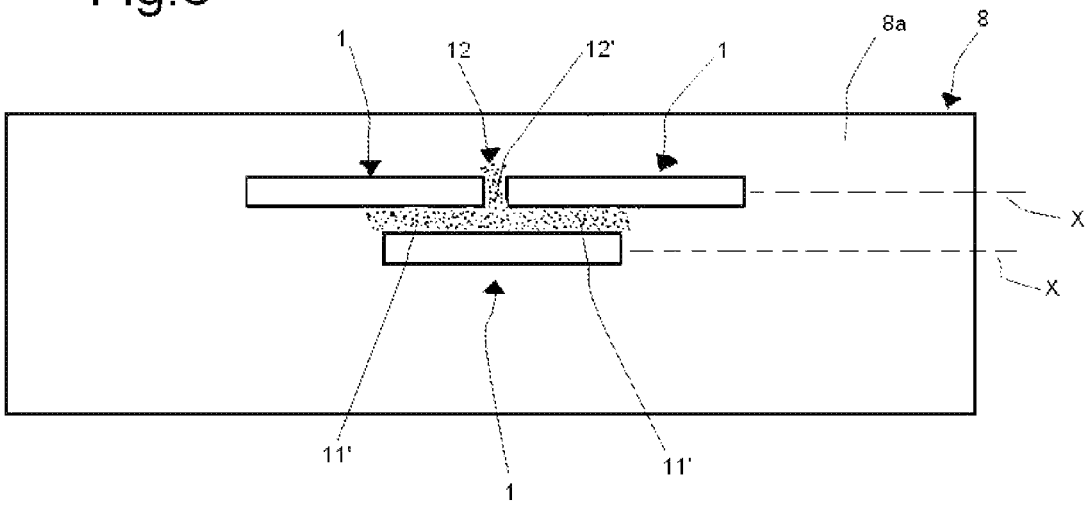

Then, as shown in FIG. 8, a group of boxes placed in mutually staggered rows—such as in the example limited to three boxes—, two boxes in an upper row and one box in a lower staggered row appearing as central with respect to the two upper rows (but the same can occur with two lower boxes placed side by side and an upper box), can profitably create a further acoustic effect similar to that of a second Helmholtz resonator on a plane parallel to the surface of the barrier. In fact, a second region 12 comprising the space 12' formed between the two upper boxes and the two gaps 11' which together form an enlarged spatial portion between the two rows, creates indeed a sort of further Helmholtz resonator, the neck of which corresponds to the space 12', so that the portion of the sound radiation tangent to the barrier and incident through the space between the side by side boxes in the same row is in its turn dampened.

The most typical situation also shown in the examples is obviously the one in which the axis of extension of the two rows are horizontal and the rows are spaced apart and superimposed one upon the other vertically. However, also geometrically different arrangements can obtain similar results.

Although a configuration of the sound absorber with a semi-cylindrical shape has been here described, it is in any case apparent that a front wall 2 which is not perfectly semi-cylindrical but is, for example, semi-elliptical or curved or polygonal in general, can also be used. The present invention has been so far described with reference to preferred embodiments. It should be understood that there can be other embodiments falling within the same inventive concept, as defined by the scope of protection of the following claims.

The invention claimed is:

1. A noise structure comprising a barrier made of a generally sound redirecting material defining a barrier surface, and a plurality of sound absorbing boxes connected to said surface, each box having an elongated configuration according to a longitudinal axis and comprising a substantially flat rear wall and a front wall with an extensive distribution of holes, said walls defining a longitudinal channel which develops along said axis and is at least partially occupied by a filling made of a sound absorbing material, wherein said front and rear walls are both on a same side of the barrier as defined by said barrier surface, and that said rear wall is a generally flat wall mounted parallel to and spaced apart from said surface of the barrier and has in its turn an extensive distribution of holes, wherein at least a group of said sound absorbing boxes provides for at least two rows of boxes, each row comprising at least one box, the rows extending along respective parallel axis and being spaced apart on a plane parallel to said surface of the barrier orthogonally with respect to said axis, thus forming respective gaps, thereby a first region is delimited between the boxes of different rows, the surface of the barrier and the rear walls of the boxes, said first region defining a first Helmholtz resonator in a direction orthogonal to the surface of the barrier, the neck of the first resonator corresponding to a gap between two boxes of different rows.

2. The structure according to claim 1, wherein said rear wall of the box and said surface of the barrier are spaced apart at a distance between 2 cm and 9 cm.

3. The structure according to claim 2, wherein said rear wall of the box and said surface of the barrier are spaced apart at a distance between 3 cm and 4 cm.

4. The structure according to claim 1, wherein said front wall is a prismatic, semi-cylindrical or a concave wall with an axis parallel to said longitudinal axis.

5. The structure according to claim 4, wherein said front wall is semi-cylindrical with a radius of curvature between 10 cm and 13 cm.

6. The structure according to claim 5, wherein said radius of curvature is 11.5 cm.

7. The structure according to claim 1, wherein said longitudinal channel is closed by two side walls which are substantially orthogonal with respect to said longitudinal axis and have in their turn an extensive distribution of holes.

8. The structure according to claim 1, wherein one or more studs project orthogonally from said rear wall towards said surface of the barrier, each stud being provided at its free end with an enlarged head which engages by sliding in a linear track connected to said surface of the barrier.

9. The structure according to claim 4, wherein fastening wings for connecting the box to the surface of the barrier integrally develop from said front wall beyond said rear wall.

10. The structure according to claim 1, wherein said filling made of sound absorbing material comprises a base layer placed parallel and adjacent to said flat rear wall and a plurality of front layers superimposed one upon the other on respective planes orthogonal to said rear wall and parallel to said axis, such front layers having a rear end close to said base layer and a front end distanced from said front wall, the front ends being mutually staggered between two or more adjacent layers so as to determine a stepped front of said filling.

11. The structure according to claim 10, wherein said filling material has a fibrous structure with unidirectional disposition of the fibers, in at least some of the said front layers the fibers having a direction orthogonal to said rear wall.

12. The structure according to claim 11, wherein for at least some of the mentioned front layers of the filling said fibers are irregularly exposed on said front ends.

13. The structure according to claim 1, wherein the filling material is:

a polyester felt;
mineral wool; or
glass wool.

14. The structure according to claim 1, wherein at least one of said rows comprises at least two boxes arranged in a side-by-side relationship along a common longitudinal axis, the boxes being mutually and longitudinally staggered between two adjacent rows, so as to delimit a second region between two boxes placed side by side in the same row, distanced by a given space, and a staggered box belonging to an adjacent row, said second region defining a second Helmholtz resonator in a direction parallel to the surface of the barrier, the neck of the second resonator corresponding to said space between the two said boxes placed side by side.

15. The structure according to claim 1, wherein said axis of extension of the rows are horizontal, the rows being spaced apart and superimposed one upon the other vertically.

16. A sound absorbing box comprising connection means for the connection to a surface of a noise barrier, the box having an elongated configuration according to a longitudinal axis and comprising a generally flat rear wall and a front wall with an extensive distribution of holes, said walls delimiting a longitudinal channel which develops along said axis and is at least partially occupied by a filling made of a sound absorbing material, wherein the rear wall is a generally flat wall having in its turn an extensive distribution of holes, said connection means being adapted to keep both said rear wall and said front wall on a same side of the barrier as defined by said barrier surface, with said rear wall parallel to and spaced apart from the surface of the barrier, said connection means comprising one or more studs projecting orthogonally from said rear wall and provided at the free end with an enlarged head adapted to be slidingly engaged in a linear track integral with said surface of the barrier or fastening wings that integrally develop from said front wall beyond said rear wall of said box, wherein said filling made of sound absorbing material comprises a base layer placed parallel and adjacent to said flat rear wall and a plurality of front layers superimposed one upon the other on respective planes orthogonal to said rear wall and parallel to said axis, such front layers having a rear end close to said base layer and a front end distanced from said front wall, the front ends being mutually staggered between two or more adjacent layers so as to determine a stepped front of said filling.

17. The box according to claim 16, wherein said connection means are adapted to keep said rear wall of the box and said surface of the barrier spaced apart at a distance between 2 cm and 9 cm.

18. The box according to claim 17, wherein said connection means are adapted to keep said rear wall of the box and said surface of the barrier spaced apart at a distance between 3 cm and 4 cm.

19. The box according to claim 16, wherein said front wall is a prismatic, semi-cylindrical or in any case concave wall with axis parallel to said longitudinal axis.

20. The box according to claim 19, wherein said front wall is semi-cylindrical with a radius of curvature comprised between 10 cm and 13 cm.

21. The box according to claim 20, wherein said radius of curvature is of 11.5 cm.

22. The box according to claim 16, wherein said longitudinal channel is closed by two side walls which are substantially orthogonal to said longitudinal axis and have in their turn an extensive distribution of holes.

23. The box according to claim 16, wherein said filling material has a fibrous structure with unidirectional disposition of the fibers, in at least some of the said front layers the fibers having a direction orthogonal to said rear wall.

24. The box according to claim 23, in which wherein for at least some of the mentioned front layers of the filling said fibers are irregularly exposed on said ends.

25. The box according to claim 16, wherein the filling material is:

a polyester felt;
mineral wool; or
glass wool.

* * * * *